US005107755A

United States Patent [19]

Leban et al.

[11] Patent Number: 5,107,755

[45] Date of Patent: Apr. 28, 1992

[54] INCONSPICUOUS, ROOM-CEILING-MOUNTABLE, NON-PRODUCTIVE-ENERGY-LOSS-MINIMIZING, AIR DIFFUSER FOR A ROOM

[75] Inventors: Raymond F. Leban; Francis L. McCall, both of Hacienda Heights, Calif.

[73] Assignee: Leban Group, Industry, Calif.

[21] Appl. No.: 599,748

[22] Filed: Oct. 19, 1990

[51] Int. Cl.[5] ..... F24F 13/06

[52] U.S. Cl. ..... 454/302; 454/304

[58] Field of Search ..... 98/40.15, 40.16, 40.17

[56] References Cited

U.S. PATENT DOCUMENTS

| | | | |
|---|---|---|---|
| 3,103,157 | 9/1963 | Quin | 98/40.16 X |
| 3,291,028 | 12/1966 | Sylvester et al. | 98/40.15 X |
| 3,590,719 | 7/1971 | Lambert | 98/40.16 |
| 4,008,653 | 2/1977 | Tatham | 98/40.16 |

*Primary Examiner*—Harold Joyce

[57] ABSTRACT

A ceiling-mounted air diffuser apparatus in which a annular discharge opening is effectively defined at a location between an effective inner margin of a drop-ceiling-supporting framework and surrounding ceiling panels and an inwardly spacedly adjacent outer margin of an intermediate, generally similarly shaped but smaller, ceiling panel positioned in a symmetrically centered location within the large vertical ceiling opening. An enclosing upper hood forming a diffuser provided with a source of air under pressure directed against the upper side of the diffuser panel and outwardly toward a downwardly and outwardly inclined, effectively diverging, air-flow-smoothing channel lying within the air plenum chamber and communicating at its bottom, output end with the annular discharge opening, and being so positioned and so directed and having a bottom appearance, relative to the corresponding diffuser panel outer margin spaced therebelow, such as to be substantially, effectively invisible from below and, consequently, greatly reducing the saliency of the annular discharge opening, while minimizing non-productive energy losses in the nearly horizontally discharged air.

27 Claims, 3 Drawing Sheets

SLOT GAP

INCONSPICUOUS, ROOM-CEILING-MOUNTABLE, NON-PRODUCTIVE-ENERGY-LOSS-MINIMIZING, AIR DIFFUSER FOR A ROOM

FIELD OF THE INVENTION

This invention relates, generally, to an air diffuser adapted to be mounted in a ceiling (often, a so-called drop ceiling, or suspended ceiling, etc.) of a room and to direct (or move) air, in a very diffused manner, into the room through the ceiling thereof.

BACKGROUND OF THE INVENTION

Well known in the art are such ceiling-mounted air diffusers which, in each case, provide a plenum chamber above a ceiling of a room and from which air is discharged (usually, power-discharged, such as by pumping same, or the like) into the room therebelow through a suitable discharge opening (or openings) in the ceiling. Such well known prior art air diffusers, generally, require an air deflection surface appropriately positioned in the path of the airflow so as to be capable of effectively directing the airflow in (or into) a lateral outward pattern (having a substantial horizontal directional component) as it enters the room through the discharge opening (or openings) in the ceiling.

In one such prior art type of ceiling-mounted air diffuser, the above-mentioned air deflection surface is positioned at, below, or closely adjacent to, a lower surface (or plane) of the ceiling so as to provide the desired lateral deflection of the initially inappropriately directed moving air as it exits the plenum chamber into the room therebelow by way of the discharge opening (or openings) in the ceiling. In this particular prior air diffuser, it has been the conventional prior art practice to make the air deflecting member bearing the air deflection surface as part of, or in direct contact with, a ceiling suspension member (usually, a drop ceiling suspension member), or the trim thereof. Thus, this type of prior art air deflecting member forms what might be termed a deflection ledge and, preferably, should be made of very thin sheet metal, or the like, which is substantially flush with the bottom surface of the ceiling, or lower, in order to get the proper discharge air flow pattern (having a very substantial lateral directional component). However, this type of physical construction is saliently visibly obvious from below and, thus, provides a sharply discrete visual incongruity (or effective visual anomaly) for an observer in the room below looking upwardly and directly viewing the air diffuser from below. This may be architecturally and/or aesthetically undesirable for a variety of fairly obvious reasons.

A prior art type of such a deflection ledge (as referred to hereinbefore) may have a deflection ledge width of approximately 50% to 75% of the width of the corresponding discharge opening, thus greatly adding to the undesirable (design-appearance-destructive) visual anomaly, or visual incongruity effect produced thereby for any person positioned in the room below the air diffuser and looking upwardly at same, along with the rest of the drop ceiling in which the air diffuser is located. One such well known type of prior art air diffuser is described (and illustrated), for example, in prior U.S. Pat. No. 3,406,623.

Another, and later, prior art improvement is disclosed in another prior (and later) U.S. Pat. No. 4,135,441, wherein the discharge openings and the structures therein, or closely adjacent thereto, have been modified somewhat in an effort to make them less saliently visible from below, while attempting to provide the desired type of largely substantially laterally directed airlow—with limited success, it must be said because the approximately 1½ inches wide rectangular slot formed by the discharge opening is necessarily black and is very much visibly saliently obvious to a viewer positioned in a room therebelow, particularly, when contrasted to the customary white appearance of most of the rest of a conventional drop ceiling (usually made up of a plurality of similar square or rectangular white acoustic panels, or acoustic tile panels) usually supported by a generally grid-like supporting framework. Furthermore, the plenum chamber interior baffling and the energy-wasting airflow conditions provided in this prior art type of air diffuser resulted in a substantial loss of potentially available operating efficiency during use thereof.

From the above discussion of the background and field of the invention, and of the prior art (and certain prior art major disadvantages), it is believed to be clear that any improvement in the air diffuser that would make the discharge opening less visibly obvious (and less visual-design-destructive) when viewed from below, and/or any air diffuser improvement which would provide enhanced operating efficiency (usually, because of substantial minimization of non-productive energy losses in the handling of the air flow through the air diffuser) would be extremely desirable.

It is precisely the immediately hereinbefore described improvements (any or all of same), and the consequent very desirable end-results arising therefrom, which are provided by, and in, the present invention. Therefore, it can be justifiably said that the present invention has certain major advantages which virtually completely overcome various important prior art disadvantages and limitations (including, but not being limited to, those mentioned hereinbefore).

Furthermore, it should be noted that all of the aforesaid advantages effectively flow from, and occur by reason of, the generic (but-different-from-the-prior-art) novel features of the invention pointed out (in representative, but not specifically limiting form) hereinafter.

SUMMARY OF THE PRESENT INVENTION

Generally speaking, the present invention comprises a ceiling-mountable air diffuser apparatus for a modular drop ceiling (a suspended ceiling) construction in which a so-called annular (including the meaning of rectangularly annular) discharge opening is effectively defined at a location between (1), an effective inner margin (or inner edge) or a drop-ceiling-supporting framework (or multiple framework members thereof), and/or surrounding ceiling panels (usually, four such surrounding ceiling panels) supported thereby and forming a large vertically-directed opening (usually, although not always, a rectangular or square opening) extending downwardly through such a drop ceiling of multiple-panel construction, and (2), an inwardly spacedly adjacent outer margin (or outer edge) of an intermediate, generally similarly shaped, but smaller, ceiling panel (an effective diffuser panel) positioned in a symmetrically centered location within the large vertical ceiling opening in the drop ceiling and peripherally effectively suspended at multiple circularly-angularly-displaced mounting locations (often, corners, where the intermediate diffuser panel is rectangular in shape, which includes square in shape) relative to the framework (or the multiple framework members). In one preferred form, the just-described suspension of (or mounting of) the intermediate diffuser panel relative to the framework is by way of effective spaced attachment thereof to lower edge mounting portions of an enclosing upper hood means forming an effectively perforated air plenum chamber above the diffuser panel and, also, supported by the framework and effectively provided with a source of air under pressure directed against the back side (the upperside) of the diffuser panel and outwardly toward a downwardly and outwardly inclined, effectively diverging, air-flow-smoothing channel means lying within the air plenum chamber and communicating, at its bottom output end, with the annular discharge opening (or, in some cases, actually comprising same), and with said air-flow channel means being so positioned and so directed, and having a bottom appearance, relative to the corresponding diffuser panel outer margin (or outer edge), which is spaced therebelow, such as to make same (the channel means, and particularly, the inner parts and the input end thereof) virtually effectively invisible from below and, consequently, greatly reducing the saliency of the annular discharge opening (or slot), while minimizinng non-productive energy losses in the nearly horizontally discharged air.

The above occurs, primarily, because the downwardly and outwardly inclined channel means terminating in an effective output end substantially coincident with the rectangular (or square) discharge opening is so constructed, shaped and positioned (with a minimum of high impact surfaces or baffling) so as to effectively comprise, and function as, what might be termed (or called) an air-flow-redirecting and turbulent-flow-minimizing channel means of a change-of-air-flow-conditions-minimizing construction, and configuration, involving reducing inner-surface roughness, and/or reducing flow-direction rate-of-change, and/or reducing channel-interior-cross-sectional-area rate-of-change, etc.—all of which substantially reduce turbulance-caused energy losses, acoustic-radiation-caused energy losses and, consequent, volumetric flow rate reductions for a given applied pressure drop across the air diffuser.

OBJECTS OF THE INVENTION

With the above points in mind, it is an object of the present invention to provide an improved ceiling-mountable air diffuser apparatus intended, primarily, for use in a modular drop ceiling and of a largely substantially-hidden-from-view interior and edge-terminus construction such as to greatly reduce the visual saliency thereof (as seen from below) in comparison with conventional prior art ceiling-mounted air diffuser constructions intended for the same general ventilation-enhancing purposes, and, thus virtually eliminating architecturally-based and/or aesthetically-based objections thereto (as essentially design-destructive, etc.).

It is a further object to provide ceiling-mountable air diffuser apparatus of an air-flow efficiency-improving character such as to substantially reduce non-productive air-flow energy losses, and/or the, consequent, volumetric air-flow rate reductions, per unit of applied pressure drop, by minimizing: (1) impact-caused energy losses, (2) change-of-air-flow-direction-caused energy losses, (3) change-of-air-flow-path-cross-sectional-area-caused energy losses, and/or (4) excessive-friction-caused energy losses, or any or all of same in any desired combination thereof.

It is a further object to provide composite air diffuser apparatus per the two preceding objects in any and all possible combinations thereof, or of any and all sub-portions or sub-parts thereof.

It is a further object to provide apparatus of the general character referred to in the foregoing Objects, Summary, and elsewhere in this present specification, and referred to in the various described features thereof, in any and all possible combinations thereof, generically and/or specifically, and which may include any or all of said features, either individually or in combination. Furthermore, the improved apparatus is of a construction such as to be capable of being manufactured and/or installed at a moderate cost which will be conducive to widespread use of the apparatus for the purposes referred to herein, or for any other substantially equivalent or appropriate purposes.

Further objects are implicit in the detailed description which follows hereinafter (which is to be considered as exemplary of, but not specifically limiting, the present invention), and such further objects will be apparent to persons skilled in the art after careful study of the detailed description which follows.

For the purpose of clarifying the nature of the improvements only of the present invention, several exemplary embodiments are illustrated (fragmentarily and partially only) in the accompanying drawings and are described in detail hereinafter.

BRIEF DESCRIPTION OF THE DRAWING FIGURES

FIG. 1 is a fragmentary, partial, side view, partly in cross-section and partly in side elevation, of one exemplary (representative, but non-specifically limiting) form of a ceiling-mountable air diffuser constructed in accordance with the teachings of the present invention and shown mounted in a fragmentarily shown ceilng of the type commonly known in the art as a drop ceiling (which is a form of suspended ceiling). This construction is shown for exemplary purposes only and is not to be construed as limiting all forms of the invention thereto.

FIG. 2 is a fragmentary, partially-broken-away bottom plan view of a fragmentarily shown ceiling (a drop ceiling, in the example shown) illustrating the first exemplary form of the invention (of FIG. 1) in centrally symmetrically installed relationship with respect to four fragmentarily shown surrounding conventional ceiling panels (which are usually so-called acoustic panels, or acoustic tile panels, although, not specifically so limited). This view shows an arbitrarily-selected-first-one exemplary (but non-specifically-limiting) type of diffuser panel mounting arrangement.

FIG. 3 is an enlarged, fragmentary, partially-broken-away view largely in cross-section taken along the plane, and in the direction indicated by, the arrows 3—3 of FIG. 2.

FIG. 4 is another fragmentary, partially-broken-away view, partly comprising a fragmentary, top plan view, and partly being a sectional view, taken along the staggered plane, and in the direction indicated by, the arrows 4—4 of FIG. 3. It is a representative view of one only of the four similar corners of the complete air diffuser and is to be taken as representative of the other three similar corners thereof, which are not individually shown because it would, quite obviously, be redundant to do so.

Figures 3, 4, 9, 10, 11, 12, 13, 14:
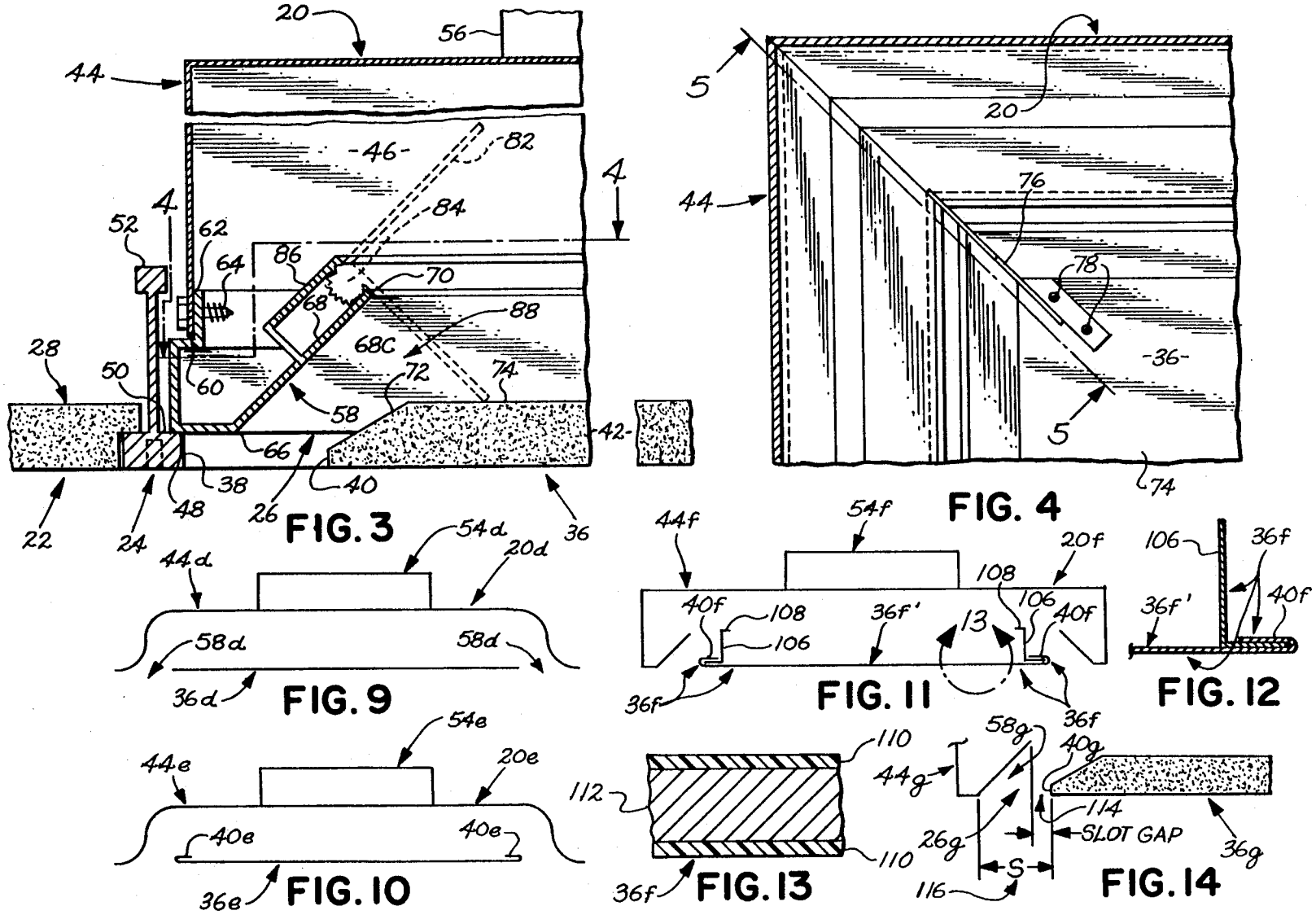
FIG. 9 is a view generally similar to FIG. 1 or FIG. 3, but is entirely diagrammatic (non-structural) in nature and illustrates a slight variation in the shape of (and the construction of) the air-flow channel means and the air-egressing slot means.
FIG. 10 is a view similar to FIG. 9, but illustrates a hemmed diffuser panel modification thereof.
FIG. 11 is a view generally similar to FIG. 9, but illustrates a diffuser panel (of thin-sheet material) having an upstanding outer edge portion (or means) clamped into the effectively hemmed edge of the diffuser panel.
Figure 5:
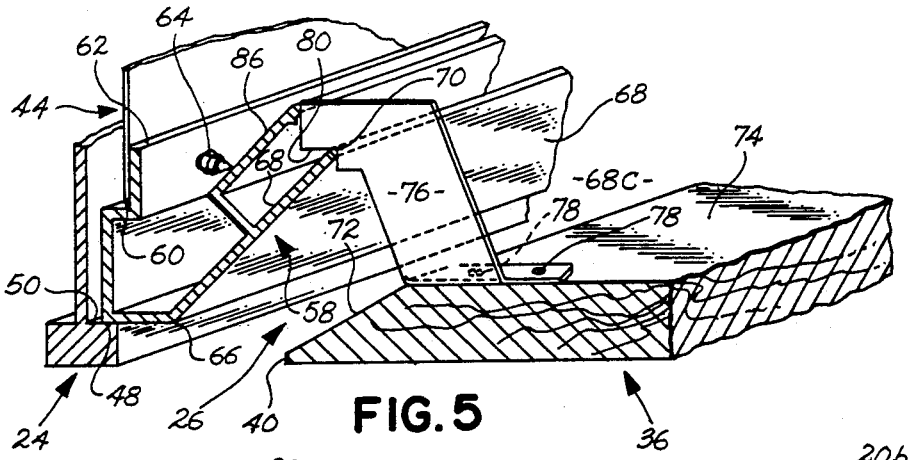
FIG. 5 is a further enlarged, fragmentary, partially-broken-away view, taken substantially along the plane, and in the direction indicated by the arrows 5—5 of FIG. 4.

FIG. 12 fragmentarily shows one representative slight modification of the upstanding outer edge portion (or means) shown in FIG. 11.

FIG. 13 fragmentarily illustrates a coated diffuser panel version of the FIG. 12 variation—and is, also, applicable to the uncoated versions shown in FIGS. 9 and 10, when desired.

FIG. 14 is another entirely diagrammatic (non-structural) view of a type similar to FIG. 9, but shows a further modification of the first form of the invention, as best previously shown in FIG. 3.

DESCRIPTION OF THE DRAWINGS SHOWING CERTAIN SELECTED EXEMPLARY ONES OF THE MULTIPLE PREFERRED EMBODIMENTS OF THE PRESENT INVENTION

Generally speaking, the present invention, as first illustrated, takes the form of a ceiling-mounted air diffuser apparatus, usually, for a modular ceiling (or suspended drop ceiling) construction in which a so-called annular (including, but not limited to, the meaning of a rectangularly annular) air discharge opening is effectively defined at a location between (1) an effective inner margin (or inner edge) of a drop-ceiling-supporting framework (or multiple framework members thereof), and/or surrounding ceiling panels (usually, four in number) supported thereby and forming a large vertically-directed opening (usually a rectangular or square opening, although not so limited) extending downwardly through such a drop ceiling of multiple panel construction and (2), an inwardly spacedly adjacent outer margin (or outer edge) of an intermediate, generally similarly shaped, but smaller, ceiling panel (an effective diffuser panel) positioned in a substantially symmetrically centered location within the large vertical ceiling opening in such a drop ceiling. Specific details of one non-limiting exemplary mounting construction for mounting said diffuser panel in said substantially symmetrically centered location so as to effectively define said annular air discharge opening will be provided in greater particularity hereinafter after the immediately-hereinbefore-mentioned structures have been identified, in one representative form in each case, at one or more locations in FIGS. 1 through 5 illustrating the first exemplary, but non-limiting form of the invention, which representative identification is now specifically set forth immediately hereinafter.

The representative air diffuser apparatus of FIGS. 1–5, inclusive, is generally indicated at 20, while one typical drop (or suspended) ceiling is generally (and fragmentarily) indicated at 22, with major portions of the drop ceiling broken-away for drawing simplification (and drawing-space-saving) reasons. The drop-ceiling-supporting framework is generally (and somewhat fragmentarily) indicated at 24, while the annular air discharge opening is generally indicated at 26 in one representative, but non-specifically limiting form. The four surrounding ceiling panels (square in the example illustrated, but not specifically so limited in all forms of the invention) are generally, and very fragmentarily, indicated at 28, 30, 32 and 34, while the slightly smaller, but generally similarly shaped (square in the example illustrated) intermediate diffuser panel is indicated generally at 36.

Said effective inner margin (or edge) is best illustrated at 38 in one representative showing thereof in FIG. 3, while said outer margin (or edge) is best illustrated at 40 in one representative showing thereof in FIG. 3. Said large vertically-directed opening (square, in the example illustrated, although not specifically so limited in all forms of the invention), and normally largely closed off (except for the annular air discharge opening 26) by the intermediate diffuser panel 36, is best indicated in FIG. 3 at 42 where a portion of said intermediate diffuser panel 36 is shown broken away (on the drawing only—not in the corresponding real apparatus) so the location of said large drop ceiling opening before the air diffuser apparatus 20 is mounted partially therein and partially thereover can be clearly understood.

The air diffuser apparatus 20 also includes an effectively downwardly open enclosing upper hood means 44 forming a perforated air plenum chamber 46 above the intermediate diffuser panel 36 and having four rectangularly-related-to-each-other lower edge mounting portions, indicated at 48 (best shown in FIG. 3) which rest upon and are supported by the corresponding laterally projecting lower effective flange portion 50 comprising said framework means 24 in a somewhat-channel-like slotted grid conformation (although not specifically so limited). The upper ends 52 (diagrammatically shown) of the ceiling-supporting framework 24 are adapted to be appropriately connected, in well known prior art ways, to an upper ceiling or upper ceiling and/or roof structural members, or upper portions of room walls and or room-wall structural members, or the like—none of which is shown since such arrangements are well known in the art and do not in any way touch upon the real inventive concept of the present invention.

The hood means 44, and the air plenum chamber 46 defined thereunder, are effectively provided with a source of air under pressure (a moving-air-source, such as a driven local or remote pump, or the like, although not so limited) indicated generally at 54, and which, in the non-limiting example shown, comprises a standard, or conventional upstanding circular entry collar 56 (or air intake means) adapted to receive (and be sealingly locked with respect to) a conventional standard input air duct (not shown since such are well known in the art). Air entering under slight pressure through such a conventional air duct is admitted into the hood 44 though the collar 56 and then flows substantially downwardly into the interior chamber 46 within the hood (or hood means) 44.

The air diffuser apparatus 20 is effectively provided with air-egress slot, or opening, means, which in the non-limiting first example illustrated in FIGS. 1–5, inclusive, comprises the previously mentioned rectangular air discharge opening 26, and which is effectively provided, inwardly thereof, with what might be termed air-flow-outwardly-and-downwardly-redirecting, and turbulent-flow-minimizing, channel means (or channel-forming-means) of a flow-smoothing construction and configuration adapted to minimize change-of-airflow conditions, such as reducing inner surface roughness, reducing flow-direction rate-of-change, and/or reducing channel-interior-cross-sectional-area rate-of-change, etc., whereby to minimize turbulence-caused energy losses, and/or volumetric flow reductions, and/or acoustic-radiation-causing energy losses, etc.

In the non-limiting example illustrated, said channel means (or channel-forming means) is indicated at 58, and, in the non-limiting form shown, comprises an aluminum extrusion for each of the four bottom edges 60 of the hood 44, and each having an inwardly offset upwardly-directed attachment edge 62 attached by multiple threaded attachment screw means 64 to the corresponding hood bottom edge 60 (best shown in FIG. 3). The channel-forming aluminum extrusion 58 then descends from the attachment edge 62 (after being outwardly slightly offset therefrom) to form the previously-mentioned lower edge mounting portions 48 which effectively mount the entire hood 44 upon the lower effective flange portion 50 of the supporting framework 24. Then the channel-forming-aluminum extrusion 58 is directed horizontally and inwardly for a very short distance into the previously mentioned rectangular air discharge opening 26 and then bends sharply upwardly at 66 to effectively form an air-flow-directing flange 68 extending angularly upwardly and inwardly into an effectively inwardly overlapping position of the inner flange end 70 so as to effectively overlap the corresponding bevelled diffuser panel outer edge means portion 40 spacedly positioned therebelow (and together with the flange 68, defining the similarly inclined channel 68C) and, therefore, causing said inner flange end 70 to be positioned substantially out of sight from a room positioned directly therebelow, and to thereby effectively visually (visibly) eliminate any viewable-from-directly-below, apparently vertically-open slot which would otherwise be saliently visibly obviously present, as seen from below.

The remainder of the downwardly and outwardly inclined channel 68C, and the modified flow path of air discharged therethrough, is defined by the bevelled surface 72 extending from the lower diffuser panel edge 40 angularly upwardly and inwardly to the flat top surface 74 of the diffuser panel 36.

In the non-limiting first example illustrated, the diffuser panel 36 is mounted in said symmetrically centered location by peripherally suspending it at multiple circularly-angularly-displaced mounting locations (usually, corner locations when the diffuser panel 36 is square, although not specifically so limited). In the first example illustrated, this is accomplished by providing four corner-mounted attachment clips, or brackets, such as the exemplary one (of the total of four) shown at 76 (best seen in FIG. 4 and FIG. 5) which is attached by attachment means 78 (threaded mounting-clip-attachment means, in the example illustrated, although not so limited) to the top surface 74 of the diffuser panel 36 at each of the four corners thereof, and then engaging an outer notched engagement end 80 of each of the four mounting clips 76 with the previously mentioned upper inner end 70 of the channel-forming-flange 68, whereby to effectively suspend the diffuser panel 36 with respect to the framework 24 in the desired symmetrically centered and slightly-centrally-size-reduced relationship thereto for effectively defining said desired rectangular air discharge opening 26.

Optional structure has been provided for mounting an optional flow-adjusting and/or blank-off vane, such as the exemplary, but non-limiting one shown in broken lines at 82, which has a serrated cylindrical base portion 84 resiliently held between the upper surface of the previously-mentioned angular flange 68 and the ribbed lower (inner) surface of an additional, substantially parallel, upper, bifurcation-producing or yoke-producing member 86. The structure is such that the optional vane 82 may be adjusted into (and subsequently maintained in) any desired permissible position between a full-flow position and zero-flow position, as desired.

In operation, air admitted into the hood 44 directly strikes the upper surface 74 of the diffuser panel 36 and is deflected outwardly in all directions into the input end 88 of each of the four portions of the air-flow-smoothing channel 68C (as permitted by the positional adjustment of any or all of the four optional vanes 82, if present). Then the air flows smoothly and in a turbulence-reduced manner downwardly and angularly outwardly and out of the air-flow discharge opening 26 (or out of any and/or all of the four portions thereof, as permitted by the adjustment of the optional vane 82, if it is present) in a substantially ceiling-hugging manner having a major horizontal directional component and does so in such an energy-loss-minimizing manner that air-flow volume is maximized for any given pressure drop across the air diffuser apparatus, while undesirable noise (acoustic radiation, etc.) is minimized for any given volumetric flow rate, and, even, for any given pressure drop across the air diffuser apparatus.

Each of the various elements of the invention may be made of any suitable or appropriate material (or materials) including various metals, wood and/or composition wood products, various plastics, moldable ceramic and/or refractory materials products, wallboard-like products, gypsum-board-like products, acoustic panels, etc. However, in the representative first embodiment of the invention described hereinbefore, the ceiling panels 28, 30, 32 and 34, and the diffuser panel 36 are shown as being panels made of so-called, acoustic tile or any appropriate acoustic panelling material having the desired sound-deadening or sound absorption characteristics and/or flame-retarding characteristics, but they are not limited thereto. The framework 24 consists of longitudinal and lateral strip-like framework members (or runners) usually made of metal such as extruded aluminum, steel, or the like, appropriately formed, such as by extrusion, rolling, or any desired metal-shaping process, but they are not limited thereto. Somewhat the same thing can be said about the hood 44, although, in one exemplary form, it may be made out of sheet metal, or the like. However, it is not so limited. Also, the mounting clips 76 and/or the optional vane 82 may be made of metal or plastic, or other suitable material, as desired or as essentially specified (dictated) by its design requirements.

The channel-forming flange 68 (and connected parts) may, preferably, be made of aluminum and, preferably, may be formed by extrusion. Also, its underside is preferably light in color—sometimes white, or shades of near white—so as to better blend in with the usual light (or white or near white) appearance of the multiple ceiling panels of the usual drop ceiling (often made of white or near white acoustic tile, although not specifically so limited).

The framework 24 can be designed with standard (or conventional) two feet or four feet intervals between centers, or with any other interval spacings of the effective centers which may be desired; or the large vertical openings 42 defined within the framework 24 can be changed from being square in shape to a rectangular shape longer in a first direction than in a second direction across and perpendicular to the first direction, such as four feet long by two feet wide, for example. In other words, the shape and/or the size of each of the ceiling openings 42 can be changed virtually as needed or desired.

The air diffuser 20 of the first form of the present invention is preferably designed to appropriately fit into a two feet by two feet square opening 42 in the framework 24, but may be designed to fit a two feet by four feet opening 42 or a four feet by four feet opening, or an opening of any other desired or needed dimensions.

With reference to the hereinbefore mentioned greatly improved operating efficiency of the air diffuser 20 of the present invention (and the four portions of the airflow-smoothing, turbulence-reducing, and non-productive-energy-loss-minimizing channel, or channel means 68C), it may be efficiency-compared with the present co-inventor's earlier U.S. Pat. No. 4,135,441, as follows. If each has an annular slot (a rectangular or square annular slot around a square of roughly two feet by two feet), and if the vertically-directed annular slot shown in said prior U.S. Pat. No. 4,135,441 is 1½ inches wide (in a horizontal direction) and if the downwardly and angularly outwardly directed channel 68C shown in FIG. 3 of the present invention is 7/8 of an inch wide (measured normal to its outward and downward angular direction), for a given pressure drop across the air diffuser, the improved-efficiency apparatus of the present invention will move 550 cubic feet per minute of air through its 7/8 inch slot as compared to the apparatus of said prior U.S. Pat. No. 4,135,441, which will move only 425 cubic feet per minute of air through its 1½ inches wide output slot, while both have similar noise levels.

To put it another way, if the older air diffuser apparatus shown in said prior U.S. Pat. No. 4,135,441 has the pressure drop there across increased until it does move 550 cubic feet per minute across its 1½ inches wide output slot, it will be found that both the both the required activating pressure drop and the undesired output noise produced by said prior art apparatus are very substantially greater than in the improved-operating-efficiency apparatus of the present invention.

Figure 6:
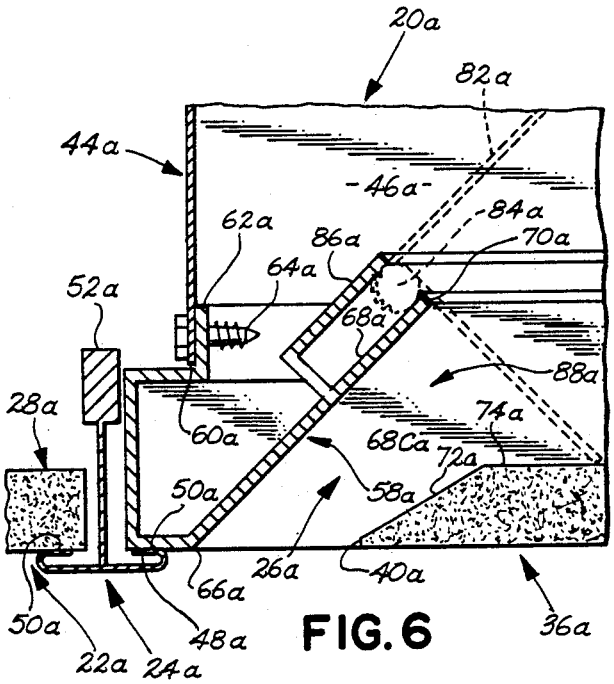
FIG. 6 is a view generally similar to FIG. 3, but illustrating a slight variation of the suspension apparatus (or so-called framework, etc.).

FIG. 6 illustrates a slight (very slight) modification of the already-described-in-detail first form of the invention illustrated in FIGS. 1-5, inclusive. In fact only the supporting framework (and its engagement with the parts supported thereby) have substantially changed at all in this very slight modification.

Functionally similar (and changed) parts are designated, in FIG. 6, by reference numerals (and/or characters) similar to those used in FIG. 3 illustrating the first form of the invention, but followed by a small (lowercase) "a" in FIG. 6, however, to separately distinguish same. Therefore, the previous full description of FIG. 3 (and of the entire first form of the invention shown in FIGS. 1-5, inclusive) can be applied to the showing of FIG. 6, thus eliminating the need for any additional (and obviously redundant) detailed description of FIG. 6 except for the very minor changes, specifically.

For example, the supporting framework **24*a* shown in FIG. 6 is no longer of the slot-grid type shown in FIG. 3 at 24, but is now of a very slightly changed type which might be referred to as an exposed (very slightly exposed) T-type wherein the bottom head having upper abutment (and supporting) surfaces 50*a* is in the form (configuration as seen in end elevation) of an inverted T and wherein one of said upper abutment surfaces 50*a* (on one side flange of the inverted T) abuts and supports the corresponding lower edge mounting portion 48*a* of the hood 44 in essentially the same manner as previously shown in FIG. 3 and previously described. The other upper abutment surface 50*a* (on the opposite side flange of the inverted T) abuts and supports the bottom edge surface of the next leftwardly adjacent ceiling panel 28*a*. It should be noted that the bottom part of the aluminum extrusion effectively forming said lower edge mounting portion 48*a* extends downwardly a short distance farther than in FIG. 3**, to extend to the common bottom plane of the ceiling panels of the drop ceiling, but is otherwise substantially unchanged.

Figure 7:
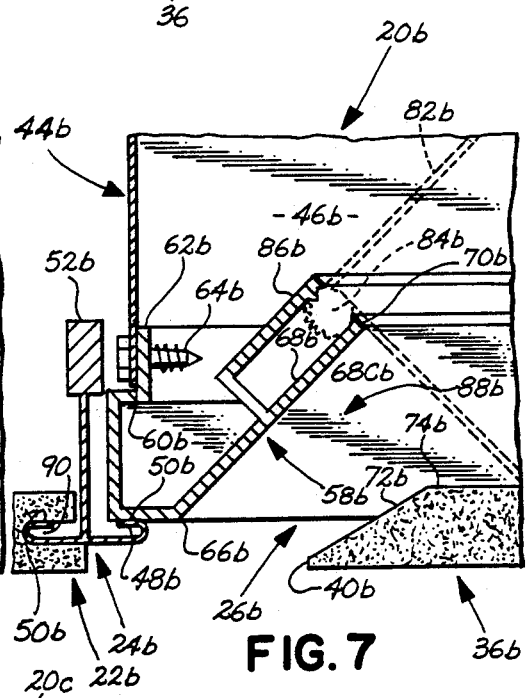
FIG. 7 is another view quite similar to FIG. 3 or FIG. 6, but illustrating another slight variation in the mode of ceiling and air diffuser suspension.

FIG. 7 shows another very slight variation, primarily, another very slight variation of the suspending framework (or framework means) of the first form of the invention, particularly as shown in prior FIG. 3. As shown in FIG. 7, said supporting framework is generally indicated at **24*b* and it is shown as being of the same inverted T type as is shown in FIG. 6 (rather than being of the slot-grid type as shown at 24 in FIG. 3), but the enlarged bottom head (or double flange) of the inverted T and, particularly the abutment parts thereof, indicated in FIG. 7 at 50*b*, are very slightly elevated from the showing of FIG. 6 so that one flange of the inverted T (the left one as shown in FIG. 7) engages, and supports, the next leftwardly adjacent ceiling panel 28*b* in a mid-plane horizontal flange-receiving slot 90** so as to substantially conceal the engaged portion of the inverted T (a so-called concealed T construction).

Otherwise, the structure shown in FIG. 7 is substantially the same as that previously shown and previously described in detail, and therefore, applicable to FIG. 7.

Figure 8:
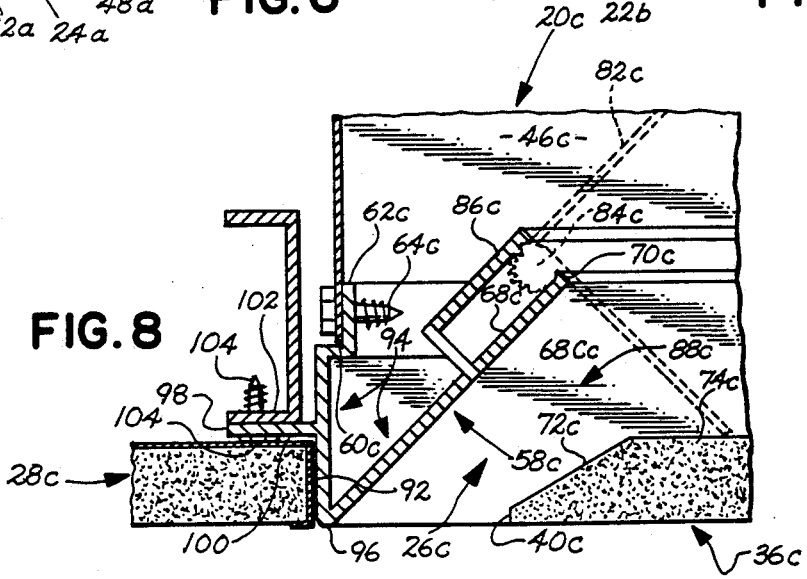
FIG. 8 is a further view generally similar to FIGS. 3, 6 and 7, but slightly modified so as to be capable of cooperating with a ceiling having adjacent panels made of other materials—in some cases, having certain limitations and/or restrictions applicable thereto—such as gypsum board, or the like (although, not specifically so limited).

FIG. 8 is another view generally similar to FIGS. 3, 6, and 7, illustrating another very slight variation of the invention intended primarily for use with ceilings (usually, drop ceilings) made up of multiple ceiling panels of less adaptable construction and/or composition, such as what is known in the art as gypsum board, or the like, for example, although not specifically so limited.

In the slightly modified construction of FIG. 8, generally similar to functionally similar parts (similar in at least some ways to previously illustrated and previously described forms of the invention) are designated by similar reference numerals, followed by the small (lower case) letter "c", however. It is clear that the slightly modified construction shown in FIG. 8 accentuates protection of the edge 92 of the adjacent gypsum board ceiling panel 28*c* and acts to prevent the marring thereof or damage thereto—to which gypsum board is very susceptible. This protective action occurs, primarily, because the aluminum extrusion 94 extends downwardly a short distance more than in FIG. 3 and terminates in a line-apex at 96 which lies in the common bottom plane of all of the ceiling panels of the ceiling (thus protecting the gypsum board edge 92), and further because said aluminum extrusion 94 has an additional horizontally projecting, partial-top-surface-protecting flange 98 which lies directly over the top surface of the edge portion 92 of the gypsum board ceiling panel 28*c* (and is there effectively fastened thereto and to members 100 and 102 by fastener 104), thereby additionally protecting same, and appropriately and equivalently mounting the gypsum board ceiling panel 28*c* in a manner substantially equivalent to the showings of FIGS. 3, 6 and 7. Otherwise, the structure shown in FIG. 8 is quite similar to the structures previously shown and previously described in detail, which descriptions are, therefore, applicable to FIG. 8.

Figure 1:
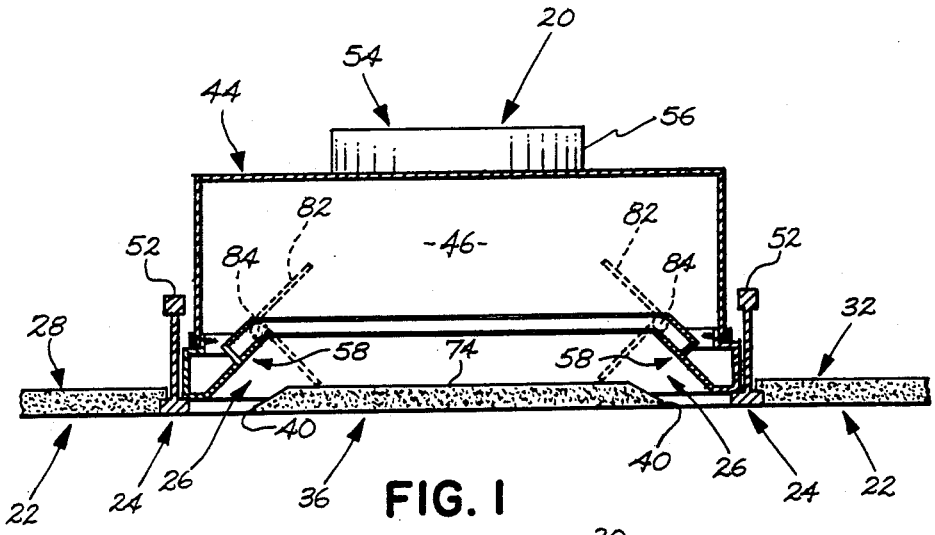
Figure 2:
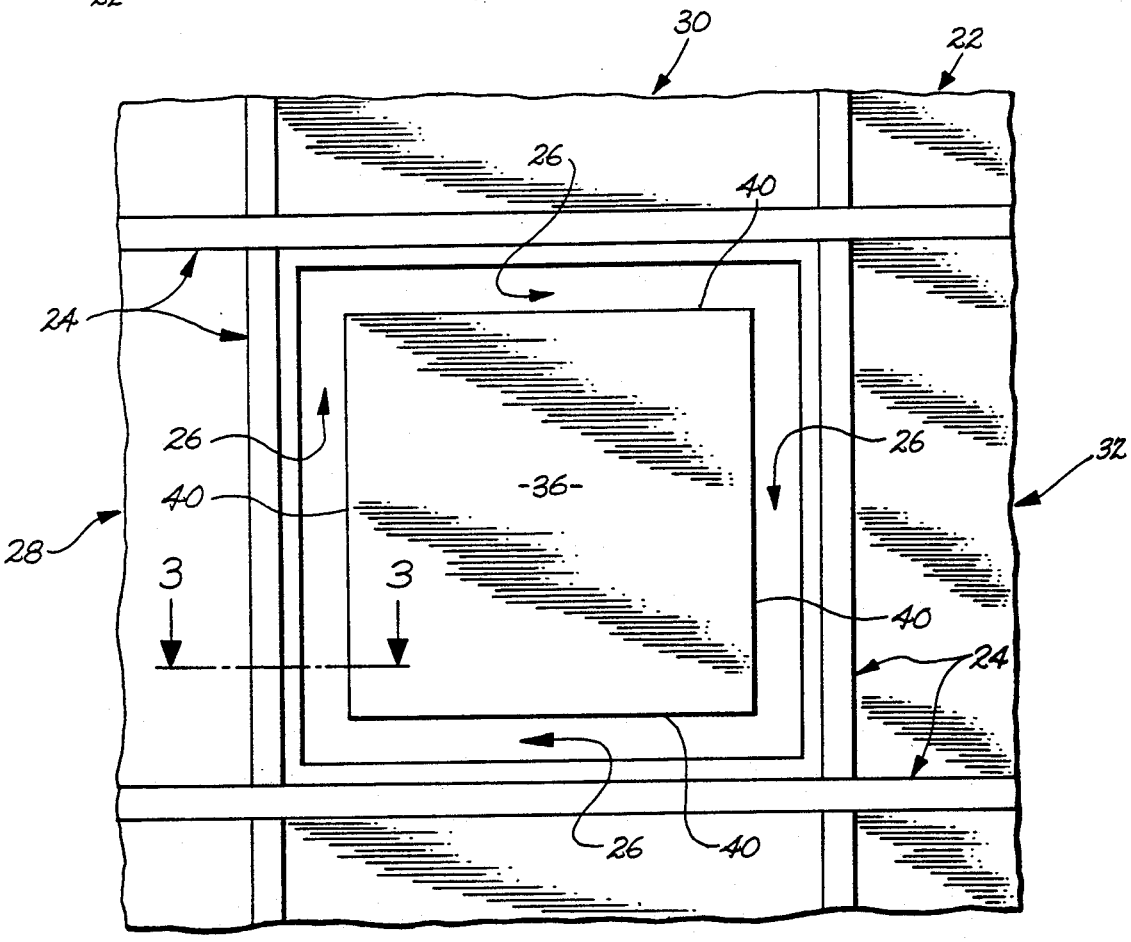

FIG. 9 is an entirely diagrammatic (non-structural) view of an aspect generally similar to FIG. 1, but showing a slight variation in the configuration of the air-flow channel means indicated generally at 58*d* and a change in both the shape and structure of the diffuser panel indicated at 36*d* which is a substantially flat plate made of any suitable material. Other parts generally and/or functionally similar to the corresponding parts of the previously described first form of the present invention shown in FIGS. 1–5, inclusive, are designated by similar reference numerals, followed by the lower case letter "d", however, and no obviously redundant description thereof is either needed or provided at this location (see previous description for the specific details of same).

FIG. 10 is another entirely diagrammatic (non-structural) view almost identical to FIG. 9, but shows the flat plate type of diffuser panel 36*e* as having hemmed other edge means 40*e*, which is a particularly suitable construction when the diffuser panel 36*e* is made of sheet metal—often painted (although not specifically limited thereto in all versions of this form of the invention). Other parts generally and/or functionally similar to the corresponding parts of the previously described first form of the present invention shown in FIGS. 1–5, inclusive, are designated by similar reference numerals, followed by the lower case letter "e", however, and no additional description thereof is needed or provided for the same reasons as those set forth at the end of the preceding paragraph.

FIG. 11 is another entirely diagrammatic (non-structural) view generally similar to FIG. 1, but showing another effective change in both the shape and structure of the diffuser panel indicated at 36*f* (which in this case is effectively composite) including at flat plate 36*f* having an effectively hemmed outer edge which is effectively folded over, and clamps and holds, an upstanding outer edge portion, or means, 106 to form a slightly modified form of the previously mentioned outer edge means, which, in this case, is indicated by the reference numeral 40*f*.

Other parts generally and/or functionally similar to the corresponding parts of the previously described first form of the present invention shown in FIGS. 1–5, inclusive, are designated by similar reference numerals, followed by the lower case letter "f", however, and no additional description thereof is needed or provided for the same reasons as those set forth at the end of the second preceding paragraph.

FIG. 12 is a fragmentary, partially broken-away view of the right portion of the diffuser panel 36*f* of FIG. 11, modified very slightly by the elimination of the inwardly-directed lip 108 shown in FIG. 11 at the top of the upstanding outer edge portion 106. Otherwise, this view is similar to FIG. 11 and, therefore, needs no further detailed description thereof.

FIG. 13 is a greatly-enlarged, fragmentary, cross-sectional view of just that representative portion of the diffuser panel 36*f* of FIG. 11 shown as being effectively enclosed within the double-headed circular arrow indicated at 13 in FIG. 11, but modified by being wrapped in, and/or covered with, a protective exterior coat, indicated in one non-limiting form at 110 in FIG. 13, and shown in said FIG. 13 as being applied to both surfaces of the thin sheet of material 112 (metal, as shown, although not so limited) forming the diffuser panel 36*f* (although, not limited to double-surface application in all forms thereof). The protective exterior coat 110, although shown as comprising plastic materials, may comprise paint, vinyl plastic, other appropriate plastic material coatings, fabric, or any other desired type of covering material—often of a type which may be said to comprise a characteristics-altering exterior coat which may effectively impart to the diffuser panel 36*f* desired acoustic characteristics (usually, sound-absorptive qualities, etc.) and/or desired fire-resistant characteristics, and/or desired design-appearance characteristics, etc., all in addition to surface protection characteristics, etc.

While FIG. 13 is shown as being derived from FIG. 11, slightly modified, it should be noted that it also applies to FIGS. 9 and 10—and, further, it should be noted that the diffuser panel in any or all of FIGS. 9–13, inclusive, may be made of metal, plastic, or an acoustic material (or acoustic tile material), which may be thicker than the thin-sheet form thereof and/or which may be effectively edge-bevelled material (usually, bevelled outwardly and downwardly, although not specifically so limited).

FIG. 14 diagrammatically illustrates a slight variation of FIG. 3 showing that the air-flow channel means 58*g* may, under certain very high-air-flow circumstances, be modified somewhat from the negative gap (positive overlap) arrangement clearly shown in FIG. 3 into a small-positive-gap (negative overlap) arrangement such as is clearly shown in FIG. 14—provided that the small positive gap (indicated at 114 in FIG. 14) is less than 20% (1/5) of the total horizontal width (116) of the air-egressing slot and annular air discharge opening 26*g*. With appropriate interior matching appearance and/or coloration of the adjacent and/or effective background parts, the very small positive gap 114 is not saliently visibly apparent from below (when viewed at a normal viewing angle, etc.) and does not substantially interfere with the desired design appearance of the entire installation when viewed from below.

Numerous modifications and variations of the invention, as disclosed herein, are possible within the broad scope and basic teachings hereof and all such are intended to be effectively included and comprehended herein.

As one non-limiting example of such a modification, it should be noted that if the ceiling panels have sufficient strength in a bending mode (or can be effectively given that strength) or are sufficiently small, to not require continuous panel-edge-support, the supporting framework can be effectively modified and/or partially eliminated, or at least greatly reduced in scope. This would mean that the framework would be intermittent and effectively spaced-apart to provide positive support to only intermittently spaced-apart portions of the ceilng panel edges (and, correspondingly, the air-diffuser edges) and would not provide virtually continuous edge support. Between such intermittently spaced-apart supported edge locations (possibly corners, although not so limited), the panel edges can abut each other in virtually butt-to-butt contact, if desired, thus even further rendering the supporting framework visually unobstrusive and even less likely to interfere with the aesthetic design appearance of a complete such ceiling, as viewed from below.

It should be understood that the accompanying drawings, and the specific descriptions thereof set forth herein, are only for the purpose of illustrating the present invention in at least several different exemplary ways, and are not to be construed as limiting the present invention to the precise and detailed specific structures shown in the drawings and specifically described hereinbefore. Rather, the real invention is intended to include any substantially equivalent constructions embodying the basic teachings and/or inventive concept of the present invention.

What is claimed is:

1. A ceiling-mounted air diffuser apparatus for directing air under pressure through a ceiling opening into a room having the ceiling thereover in an air-flow pattern extending substantially horizontally along and underneath a bottom surface of the ceiling, comprising: a grid-like ceiling-supporting framework; and multiple generally similar shaped ceiling panels, of which all but an intermediate one thereof are effectively directly supported by said framework for effectively defining at least a portion of a modular drop ceiling and further defining therein a large vertical opening through the ceiling of a desired size and shape, said multiple ceiling panels including an intermediately-positioned one thereof which is substantially vertically aligned with the large vertical opening through the ceiling and which is of substantially the same shape as, but slightly smaller than, the vertical opening, and which also has outer edge means, and which effectively comprises and defines an intermediate diffuser panel, and, further, including at least four surrounding ceiling panels spacedly positioned around the intermediate diffuser panels in closely surrounding adjacent, but slightly edge-spaced-apart relationship to the intermediate diffuser panel's corresponding outer edge means and, thus, effectively providing, at a location therebetween, air-egressing slot means taking the form of, and effectively including, an annular discharge opening at an output end thereof; hood means forming a perforated air plenum chamber above said intermediately-positioned diffuser panel and above and in air-flow communication with said air-egressing slot means and annular discharge opening; said air-egressing slot means and said annular discharge opening being effectively provided with air-flow-redirecting means operable to redirect input pressurized air very slightly downwardly and, primarily, outwardly through said annular discharge opening and, also, effectively comprising air-flow-smoothing means taking the form of turbulent-flow-minimizing channel means; said diffuser panel's outer edge means being outwardly and downwardly bevelled, and a lower portion of said perforated air plenum chamber, and said hood means defining same, being effectively provided with lower edge mounting means carrying an upwardly and inwardly inclined flange forming an effective outer wall of said channel means, which is spacedly opposed to the corresponding, and similarly angularly inclined, diffuser panel bevelled outer edge means, thus forming said channel means, and which extends upwardly and angularly inwardly to an inner terminus positioned entirely within said perforated air plenum chamber and being so positioned and so directed, and having a bottom appearance, relative to the corresponding diffuser panel's bevelled outer edge means which is spacedly positioned therebelow such as to substantially and effectively cause said inner flange terminus to be positioned substantially apparently out of sight from below and to thereby effectively substantially visually eliminate any obviously viewable-from-directly-below open slot which would otherwise be saliently visibly apparent.

2. Apparatus as defined in claim 1, wherein said turbulent-flow-minimizing channel means is of a change-of-air-flow-conditions-minimizing construction and configuration whereby to minimize turbulence-caused energy losses, volumetric-flow-reductions, and radiated acoustic energy losses by reducing inner surface roughness, by reducing flow-direction rate of change of air-flow, and/or by reducing channel-interior-cross-sectional area changes along the interior of the channel means.

3. Apparatus as defined in claim 1, wherein said hood means forming said perforated air plenum chamber is effectively supported by said grid-like supporting framework.

4. Apparatus as defined in claim 2, wherein said hood means forming said perforated air plenum chamber is effectively supported by said grid-like supporting framework.

5. Apparatus, as defined in claim 1, wherein said hood means forming said perforated air plenum chamber is interiorly provided with mounting clip means each effectively attached between the interior of said hood means and the normally hidden-from-view upper side of said underlying diffuser panel at a normally unseen-from-below position within the perforated air plenum chamber and above said diffuser panel.

6. Apparatus as defined in claim 2, wherein said hood means forming said perforated air plenum chamber is interiorly provided with mounting clip means each effectively attached between the interior of said hood means and the normally hidden-from-view upper side of said underlying diffuser panel at a normally unseen-from-below position within the perforated air plenum chamber and above said diffuser panel.

7. Apparatus as defined in claim 5, wherein said hood means forming said perforated air plenum chamber is effectively supported by said grid-like supporting framework.

8. Apparatus as defined in claim 6, wherein said hood means forming said perforated air plenum chamber is effectively supported by said grid-like supporting framework.

9. Apparatus as defined in claim 8, including means operable to direct air downwardly into said perforated air plenum chamber and toward a top surface of said diffuser panel.

10. Apparatus as defined in claim 8, wherein a top surface of said diffuser panel adjacent to said channel means comprises a substantially horizontally directed air-deflection surface at the bottom of said perforated air plenum chamber.

11. Apparatus as defined in claim 8, wherein said diffuser panel has a top surface effectively comprising a substantially horizontally directed air-deflection surface at the bottom of said perforated air plenum chamber; and, further, including air-moving means for directing air downwardly into said perforated air plenum chamber and against said air-deflection surface at the bottom of said perforated air plenum chamber for outward deflection of the air toward, and into, said channel means.

12. A ceiling-mounted air diffuser apparatus for directing air under pressure through a ceiling opening into a room having the ceiling thereover in an air-flow pattern extending substantially horizontally along and underneath a bottom surface of the ceiling, comprising: a grid-like ceiling-supporting framework; and multiple generally similarly shaped ceiling panels, of which all but an intermediate one thereof are effectively directly supported by said framework for effectively defining at least a portion of a modular drop ceiling and further defining therein a large vertical opening through the ceiling of a desired size and shape, said multiple ceiling panels including an intermediately-positioned one thereof which is substantially vertically aligned with the large vertical opening through the ceiling and which is of substantially the same shape, as, but slightly smaller than, the vertical opening, and which also has outer edge means, and which effectively comprises and defines an intermediate diffuser panel, and, further, including at least four surrounding ceiling panels spacedly positioned around the intermediate diffuser panel in closely surrounding adjacent, but slightly edge-spaced-apart relationship to the intermediate diffuser panel's corresponding outer edge means and, thus, effectively providing, at a location therebetween, air-egressing slot means taking the form of, and effectively including, an annular discharge opening at an output end thereof; hood means forming a perforated air plenum chamber above said intermediately-positioned diffuser panel and above and in air-flow communication with said air-egressing slot means and annular discharge opening; said air-egressing slot means and said annular discharge opening being effectively provided with air-flow-redirecting means operable to redirect input pressurized air very slightly downwardly and, primarily, outwardly through said annular discharge opening and, also, effectively comprising air-flow-smoothing means taking the form of turbulent-flow-minimizing channel means; a lower portion of said hood means being effectively provided with an at-least-partial channel-defining wall portion extending upwardly and inwardly from said air-egressing slot means and said discharge opening and effectively forming an outer wall of said channel means opposed to, and closely outwardly spaced from, the corresponding intermediate diffuser panel outer edge means, which, also, extends upwardly and inwardly from said air-egressing slot means and said discharge opening, thus, together, effectively forming said channel means in a specific manner which causes said channel means to extend upwardly and inwardly to an inner terminus positioned substantially entirely within said air plenum chamber and being so positioned and so directed, and having a bottom appearance, relative to the corresponding diffuser panel's outer edge means which is spaced therebelow, such as to substantially and effectively cause said inner terminus to be positioned apparently substantially out of sight from below and to thereby apparently substantially visibly-obscure any obviously viewable-from-directly-below open slot and diffuser-panel-supporting structure which would otherwise be saliently visibly apparent.

13. Apparatus as defined in claim 12, wherein said turbulent-flow-minimizing channel means is of a change-of-air-flow-conditions-minimizing construction and configuration whereby to minimize turbulence-caused energy losses, volumetric-flow-reductions, and radiated acoustic energy losses by reducing inner surface roughness, by reducing flow-direction rate of change of air-flow, and/or by reducing channel-interior cross-sectional area changes along the interior of the channel means.

14. Apparatus as defined in claim 1, wherein said hood means forming said perforated air plenum chamber is effectively supported by said grid-like supporting framework.

15. Apparatus as defined in claim 13, wherein said hood means forming said perforated air plenum chamber is effectively supported by said grid-like supporting framework.

16. Apparatus as defined in claim 12, wherein said hood means forming said perforated air plenum chamber is interiorly provided with mounting clip means each effectively attached between the interior of said hood means and the normally hidden-from-view upper-side of said underlying diffuser panel at a normally unseen-from-below position within the perforated air plenum chamber and above said diffuser panel.

17. Apparatus as defined in claim 13, wherein said hood means forming said perforated air plenum chamber is interiorly provided with mounting clip means each effectively attached between the interior of said hood means and the normally hidden-from-view upper side of said underlying diffuser panel at a normally unseen-from-below position within the perforated air plenum chamber and above said diffuser panel.

18. Apparatus as defined in claim 16, wherein said hood means forming said perforated air plenum chamber is effectively supported by said grid-like supporting framework.

19. Apparatus as defined in claim 17, wherein said hood means forming said perforated air plenum chamber is effectively supported by said grid-like supporting framework.

20. A ceiling-mounted air diffuser apparatus for directing air under pressure through a ceiling opening into a room having the ceiling thereover in an air-flow pattern extending substantially horizontally along and underneath a bottom surface of the ceiling, comprising: a grid-like ceiling-supported framework; and multiple generally similarly shaped ceiling panels, of which all but an intermediate one thereof are effectively directly supported by said framework for effectively defining at least a portion of a modular drop ceiling and further defining therein a large vertical opening through the ceiling of a desired size and shape, said multiple ceiling panels including an intermediately-positioned one thereof which is substantially vertically aligned with the large vertical opening through the ceiling and which is of substantially the same shape as, but slightly smaller than, the vertical opening, and which also has outer edge means, and which effectively comprises and defines an intermediate diffuser panel, and, further, including at least four surrounding ceiling panels spacedly positioned around the intermediate diffuser panel in closely surrounding adjacent, but slightly edge-spaced-apart relationship to the intermediate diffuser panel's corresponding outer edge means and, thus, effectively providing at a location therebetween, air-egressing slot means taking the form of, and effectively including, an annular discharge opening at an output end thereof; hood means provided with air intake means and cooperating with a top surface of said diffuser panel to cause said top surface to effectively comprise, and function as, an outward air-deflection surface for causing outward air-flow deflection and conveyance from said air intake means to said air-egressing slot means and annular discharge opening; said air-egressing slot means and said annular discharge opening being effectively provided with air-flow-redirecting means operable to redirect input pressurized air very slightly downwardly and, primarily, outwardly through said annular discharge opening and, also, effectively comprising air-flow-smoothing means taking the form of turbulent-flow-minimizing channel means; said diffuser panel comprising a substantially flat plate; a lower portion of said hood means being effectively provided with an at-least-partial channel-defining wall portion extending upwardly and inwardly from said air-egressing slot means and said discharge opening and effectively forming an outer wall of said channel means opposed to, and closely outwardly spaced from, the corresponding intermediate diffuser panel outer edge means, which, also, extends upwardly and inwardly from said air-egressing slot means and said discharge opening, thus, together, effectively forming said channel means in a specific manner which causes said channel means to extend upwardly and inwardly to an inner terminus positioned substantially entirely within said hood means and being so positioned and so directed, and having a bottom appearance, relative to the corresponding diffuser panel's outer edge means which is spaced therebelow, such as to substantially and effectively cause said inner terminus to be positioned apparently substantially out of sight from below and to thereby apparently substantially visibly-obfuscate any obviously viewable-from-directly-below open slot and diffuser-panel-supporting structure which would otherwise be saliently visibly apparent.

21. Apparatus as defined in claim 20, wherein said diffuser panel is provided with, and is effectively wrapped in, and covered with, a protective, characteristics-altering exterior coat.

22. Apparatus as defined in claim 20, wherein said diffuser panel is provided with, and is effectively wrapped in, and covered with, a protective, characteristics-altering exterior coat of fabric material.

23. Apparatus as defined in claim 20, wherein said diffuser panel is provided with, and is effectively wrapped in, and covered with, a protective, characteristics-altering exterior coat of plastic material.

24. A ceiling-mounted air diffuser apparatus for directing air under pressure through a ceiling opening into a room having the ceiling thereover in an airflow pattern extending substantially horizontally along and underneath a bottom surface of the ceiling, comprising: a grid-like ceiling-supporting framework; and multiple generally similarly shaped ceiling panels, of which all but an intermediate one thereof are effectively directly supported by said framework for effectively defining at least a portion of a modular drop ceiling and further defining therein a large vertical opening through the ceiling of a desired size and shape, said multiple ceiling panels including an intermediately-positioned one thereof which is substantially vertically aligned with the large vertical opening through the ceiling and which is of substantially the same shape as, but slightly smaller than, the vertical opening, and which also has outer edge means, and which effectively comprises and defines an intermediate diffuser panel, and, further, including at least four surrounding ceiling panels spacedly positioned around the intermediate diffuser panel in closely surrounding adjacent, but slightly edge-spaced-apart relationship to the intermediate diffuser panel's corresponding outer edge means and, thus, effectively providing, at a location therebetween, air-egressing slot means taking the form of, and effectively including, an annular discharge opening at an output end thereof; hood means provided with air intake means and cooperating with a top surface of said diffuser panel to cause said top surface to effectively comprise, and function as, an outward air-deflection surface for causing outward air-flow deflection and conveyance from said air intake means to said air-egressing slot means and annular discharge opening, said air-egressing slot means and said annular discharge opening being effectively provided with air-flow-redirecting means operable to redirect input pressurized air very slightly downwardly and, primarily, outwardly through said annular discharge opening and, also, effectively comprising air-flow-smoothing means taking the form of turbulent-flow-minimizing channel means; said diffuser panel comprising a hemmed sheet-metal diffuser panel; a lower portion of said hood means being effectively provided with an at-least-partial channel-defining wall portion extending upwardly and inwardly from said air-egressing slot means and said discharge opening and effectively forming an outer wall of said channel means opposed to, and closely outwardly spaced from, the corresponding intermediate diffuser panel outer edge means, which, also, extends upwardly and inwardly from said air-egressing slot means and said discharge opening, thus, together, effectively forming said channel means in a specific manner which causes said channel means to extend upwardly and inwardly to an inner terminus positioned substantially entirely within said air plenum chamber and hood means and being so positioned and so directed, and having a bottom appearance, relative to the corresponding diffuser panel's outer edge means which is spaced therebelow, such as to substantially and effectively cause said inner terminus to be positioned apparently substantially out of sight from below and to thereby apparently substantially visibly-obliterate any obviously viewable-from-directly-below open slot and diffuser-panel-supporting structure which would otherwise be saliently visibly apparent.

25. Apparatus as defined in claim 24, wherein said diffuser panel is provided with, and is effectively wrapped in, and covered with, a protective, characteristics-altering exterior coat.

26. Apparatus as defined in claim 24, wherein said diffuser panel is provided with, and is effectively wrapped in, and covered with, a protective, characteristics-altering exterior coat of fabric material.

27. Apparatus as defined in claim 24, wherein said diffuser panel is provided with, and is effectively wrapped in, and covered with, a protective, characteristics-altering exterior coat of plastic material.

* * * * *